US009394598B2

(12) United States Patent
Sato

(10) Patent No.: US 9,394,598 B2
(45) Date of Patent: Jul. 19, 2016

(54) POWDER FOR THERMAL SPRAYING AND PROCESS FOR FORMATION OF SPRAYED COATING

(75) Inventor: Kazuto Sato, Kakamigahara (JP)

(73) Assignee: FUJIFILM INCORPORATED, Kiyosu-Shi (JP)

( * ) Notice: Subject to any disclaimer, the term of this patent is extended or adjusted under 35 U.S.C. 154(b) by 636 days.

(21) Appl. No.: 13/805,980

(22) PCT Filed: Jun. 30, 2011

(86) PCT No.: PCT/JP2011/065002

§ 371 (c)(1), (2), (4) Date: Dec. 20, 2012

(87) PCT Pub. No.: WO2012/002475

PCT Pub. Date: Jan. 5, 2012

(65) Prior Publication Data

US 2013/0095250 A1 Apr. 18, 2013

(30) Foreign Application Priority Data

Jul. 2, 2010 (JP) ..... 2010-152403

(51) Int. Cl.

| | |
|---|---|
| ***C22C 29/06*** | (2006.01) |
| ***C23C 4/06*** | (2016.01) |
| ***C23C 24/04*** | (2006.01) |
| ***C23C 4/04*** | (2006.01) |
| *C22C 29/08* | (2006.01) |

(52) U.S. Cl.

CPC . *C23C 4/06* (2013.01); *C22C 29/06* (2013.01); *C23C 4/04* (2013.01); *C23C 24/04* (2013.01); *C22C 29/08* (2013.01); *Y10T 428/2989* (2015.01)

(58) Field of Classification Search

CPC ..... C22C 29/082; C22C 29/06; C22C 29/08

See application file for complete search history.

(56) References Cited

U.S. PATENT DOCUMENTS

| | | | | |
|---|---|---|---|---|
| 7,837,967 | B2 | 11/2010 | Aoki et al. | |
| 2006/0053967 | A1 * | 3/2006 | Mizuno et al. | 75/240 |
| 2007/0243335 | A1 * | 10/2007 | Belashchenko | 427/451 |
| 2008/0112873 | A1 | 5/2008 | Aoki et al. | |
| 2008/0245185 | A1 * | 10/2008 | Mizuno et al. | 75/255 |
| 2010/0047622 | A1 * | 2/2010 | Fischer et al. | 428/698 |
| 2010/0075133 | A1 * | 3/2010 | Ikeda et al. | 428/320.2 |

FOREIGN PATENT DOCUMENTS

| | | | |
|---|---|---|---|
| JP | 2004-124129 | A | 4/2004 |
| JP | 2005-029858 | A | 2/2005 |
| JP | 2005-155711 | A | 6/2005 |
| JP | 2008-115407 | A | 5/2008 |
| JP | 2008-231527 | A | 10/2008 |
| JP | 2010-111906 | A | 5/2010 |
| JP | 2010-129934 | A | 6/2010 |

* cited by examiner

*Primary Examiner* — George Wyszomierski
*Assistant Examiner* — Ngoclan T Mai
(74) *Attorney, Agent, or Firm* — Foley & Lardner LLP

(57) ABSTRACT

A thermal spray powder, which includes granulated and sintered cermet particles that contain a metal having an indentation hardness of 500 to 5,000 N/mm$^2$, is disclosed. The granulated and sintered cermet particles have an average size of 30 μm or less. The granulated and sintered cermet particles are composed of primary particles having an average size of 6 μm or less. The granulated and sintered cermet particles have a compressive strength of from 100 to 600 MPa. It is preferable that the metal contained in the granulated and sintered cermet particles includes at least one selected from the group consisting of cobalt, nickel, iron, aluminum, copper, and silver. The thermal spray powder is usable in a low-temperature thermal spraying process such as cold spraying using nitrogen as a working gas.

3 Claims, No Drawings

POWDER FOR THERMAL SPRAYING AND PROCESS FOR FORMATION OF SPRAYED COATING

TECHNICAL FIELD

The present invention relates to a thermal spray powder that is usable in a low-temperature thermal spraying process and to a method for forming a thermal spray coating by using the thermal spray powder.

BACKGROUND ART

Thermal spraying, which is one widely used method among known surface modification methods, involves forming a coating on a substrate through spraying, onto the substrate, of a thermal spray powder that is made of a material such as metal, ceramic, and cermet, by using a heat source, for instance a combustion flame or a plasma jet. The thermal spray powder is typically heated to a temperature equal to or higher than its melting point or softening point by the heat source. Therefore, the substrate may undergo thermal alteration or thermal deformation, depending on the material and shape of the substrate. Accordingly, it is not possible to form a coating on a substrate of any material and shape by ordinary thermal spraying. This is disadvantageous in that the material and shape of a substrate used are subject to limitation.

Low-temperature thermal spraying processes have received attention in recent years as a novel method for solving such a disadvantage of conventional thermal spraying. For instance, Patent Document 1 discloses that cold spraying is used in order to form a chromium-containing coating on the sliding surface of a piston ring. Also, Patent Document 2 discloses a powder for cold spraying that contains granulated and sintered cermet particles made of tungsten carbide and metal.

However, thick thermal spray coatings are not easy to obtain efficiently by low-temperature thermal spraying processes such as cold spraying, on account of the low process temperature that is involved. This behavior is more pronounced in powders for thermal spraying that are made of a cermet than in those that are made of metal.

PRIOR ART DOCUMENTS

Patent Document 1: Japanese Laid-Open Patent Publication No. 2005-29858

Patent Document 2: Japanese Laid-Open Patent Publication No. 2008-231527

SUMMARY OF THE INVENTION

Problems that the Invention is to Solve

Accordingly, it is an objective of the present invention to provide a thermal spray powder that is capable of efficiently forming a thick thermal spray coating by a low-temperature thermal spraying process and to provide a method for forming a thermal spray coating by using the thermal spray powder.

Means for Solving the Problems

In order to achieve the above objective and in accordance with a first aspect of the present invention, a thermal spray powder is provided that is usable in a low-temperature thermal spraying process. The thermal spray powder includes granulated and sintered cermet particles that contain a metal having an indentation hardness of 500 to 5,000 N/mm$^2$. The average particle size of the granulated and sintered cermet particles is 30 μm or less. The granulated and sintered cermet particles are composed of primary particles having an average size of 6 μm or less. The compressive strength of the granulated and sintered cermet particles is from 100 to 600 MPa.

Preferably, the metal contained in the granulated and sintered cermet particles includes at least one selected from the group consisting of cobalt, nickel, iron, aluminum, copper, and silver.

The low-temperature thermal spraying process is, for instance, cold spraying that utilizes a working gas containing nitrogen as a main component.

In accordance with a second aspect of the present invention, a method for forming a thermal spray coating is provided. The method includes forming a thermal spray coating through a low-temperature thermal spraying process of the thermal spray powder according to the first aspect of the invention.

Effects of the Invention

The present invention succeeds in providing a thermal spray powder that can efficiently form a thick thermal spray coating by a low-temperature thermal spraying process and in providing a method for forming a thermal spray coating by using the thermal spray powder.

MODES FOR CARRYING OUT THE INVENTION

One embodiment of the present invention will now be described.

The thermal spray powder of the present embodiment is formed of granulated and sintered cermet particles. Each of the granulated and sintered cermet particles is a composite particle that is obtained through agglomeration of ceramic fine particles and metal fine particles. The granulated and sintered cermet particles are produced by granulating a mixture of ceramic fine particles and metal fine particles and sintering the obtained granulated product (granulated particles).

The thermal spray powder is usable in low-temperature thermal spraying processes such as cold spraying, warm spraying, and high-velocity air-fuel (HVAF) thermal spraying, i.e., the thermal spray powder is used for applications in which a cermet thermal spray coating is formed by a low-temperature thermal spraying process. In cold spraying, a working gas at a temperature lower than the melting point and the softening point of the thermal spray powder is accelerated to supersonic velocity, and the accelerated working gas causes the thermal spray powder in a solid phase to collide against a substrate and become deposited thereon. In warm spraying, a combustion flame of a temperature lower than in the case of high-velocity oxygen-fuel (HVOF) thermal spraying is formed through mixing of nitrogen gas into a combustion flame that is obtained using kerosene and oxygen as a combustion improver to lower the temperature of the combustion flame. The thermal spray powder is heated and accelerated to supersonic velocity by that comparatively low-temperature combustion flame, and, as a result, is caused to collide against a substrate and become deposited thereon. In HVAF thermal spraying, a combustion flame of a temperature lower than in HVOF thermal spraying is formed by using air, as the combustion improver, instead of oxygen. The thermal spray powder is heated and accelerated by that combustion flame and is caused thereby to collide against a substrate and become deposited thereon. In all instances of low-temperature thermal spraying processes, the thermal spray powder is preferably not heated to a temperature that exceeds 1,500° C., at which the ceramic in the thermal spray powder, in particular tungsten carbide (WC), undergoes thermal degradation.

In general, cold spraying is further classified into high-pressure type and low-pressure type depending on the pressure of working gas. Specifically, low-pressure cold spraying denotes an instance in which the working gas pressure is 1 MPa or less, and high-pressure cold spraying denotes an instance in which the working gas pressure exceeds 1 MPa and is 5 MPa or less. An inert gas such as a gas containing helium or nitrogen as a main component, or a mixed gas of helium and nitrogen, is mainly used as the working gas in high-pressure cold spraying. The same types of gas in high-pressure cold spraying, or compressed air, are used as the working gas in low-pressure cold spraying. The thermal spray powder of the present embodiment may be used in either low-pressure cold spraying or high-pressure cold spraying. Preferably, the working gas that is used is a gas, for instance nitrogen gas or air, that contains nitrogen as a main component. Using a gas containing nitrogen as a main component is advantageous in view of lower costs, as compared with helium gas, and in view of enabling the thermal spray powder to be readily heated. The working gas is supplied to a cold spray device at a pressure that ranges preferably from 0.5 to 5 MPa, more preferably from 0.7 to 5 MPa, even more preferably from 1 to 5 MPa, and most preferably from 1 to 4 MPa, and is heated to a temperature preferably from 100 to 1,000° C., more preferably from 300 to 1,000° C., even more preferably from 500 to 1,000° C., and most preferably from 500 to 800° C. The thermal spray powder is supplied to the working gas in a direction that is coaxial with the flow of the working gas, at a supply rate that ranges preferably from 1 to 200 g/min, and more preferably from 10 to 100 g/min. During cold spraying, the distance from the distal end of the nozzle of the cold spray device to the substrate (i.e., the thermal spraying distance) ranges preferably from 5 to 100 mm, and more preferably from 10 to 50 mm, the traverse velocity of the nozzle of the cold spray device ranges preferably from 10 to 300 mm/sec, and more preferably from 10 to 150 mm/sec, and the thickness of the formed thermal spray coating ranges preferably from 50 to 1,000 μm, and more preferably from 100 to 500 μm.

Preferably, the ceramic fine particles that are used for producing the granulated and sintered cermet particles are made of a hard ceramic containing at least one selected from the group consisting of carbides such as tungsten carbide and chromium carbide, borides such as molybdenum boride and chromium boride, nitrides such as aluminum nitride, silicides, and oxides. Specifically, the ceramic in the granulated and sintered cermet particles is preferably a single-component ceramic or composite ceramic that is formed of at least one selected from the group consisting of carbides, borides, nitrides, silicides, and oxides. When, among the foregoing, the ceramic in the granulated and sintered cermet particles is any one type from among carbides, borides, and oxides, in particular carbides, a thermal spray coating having excellent abrasion resistance is easily formed by a low-temperature thermal spraying process of a thermal spray powder.

The metal fine particles that are used for producing the granulated and sintered cermet particles are made of any metal that has an indentation hardness of 500 to 5,000 N/mm$^2$. That is, the metal contained in the granulated and sintered cermet particles is any metal that has an indentation hardness of 500 to 5,000 N/mm$^2$. When the indentation hardness of the metal in the granulated and sintered cermet particles lies within the above range, sufficient plastic deformation of the granulated and sintered cermet particles for adhesion to and deposition on a substrate through collision with the substrate is readily elicited. The deposit efficiency of the thermal spray powder is improved as a result. The thermal spray coating that is formed out of the thermal spray powder exhibits superior hardness and abrasion resistance. The indentation hardness can be measured using for instance a nano-indentation hardness tester "ENT-1100a" manufactured by Elionix, with a triangular-pyramid shaped diamond indenter, at a test load of 100 mN and a step interval of 20 milliseconds.

Specific examples of metals that have an indentation hardness of 500 to 5,000 N/mm$^2$ include cobalt, nickel, iron, aluminum, copper, and silver. The metal fine particles that are used for producing the granulated and sintered cermet particles may be formed of any simple metal or any metal alloy, or any combination thereof, of at least one selected from the group consisting of cobalt, nickel, iron, aluminum, copper, and silver. Specifically, the metal in the granulated and sintered cermet particles may be any one such simple metal or metal alloy, or any combination thereof. The plastic deformability of the granulated and sintered cermet particles is increase, and as a result, the deposit efficiency of the thermal spray powder is particularly improved, when the metal in the granulated and sintered cermet particles is any simple metal or any metal alloy, or any combination thereof, including at least one selected from the group consisting of nickel, aluminum, copper, and silver.

The indentation hardness of the metal in the granulated and sintered cermet particles is preferably 700 N/mm$^2$ or more, and more preferably 1,000 N/mm$^2$ or more. The hardness and abrasion resistance of the thermal spray coating that is formed out of the thermal spray powder increase as the indentation hardness of the metal in the granulated and sintered cermet particles becomes higher.

The indentation hardness of the metal in the granulated and sintered cermet particles is preferably 4,000 N/mm$^2$ or less, and more preferably 3,000 N/mm$^2$ or less. As the indentation hardness of the metal in the granulated and sintered cermet particles becomes lower, the plastic deformability of the granulated and sintered cermet particles increases, and as a result, the deposit efficiency of the thermal spray powder increases.

The content of the ceramic in the granulated and sintered cermet particles is preferably 50% by mass or more, more preferably 60% by mass or more, even more preferably 70% by mass or more, and most preferably 80% by mass or more. In other words, the content of the metal in the granulated and sintered cermet particles is preferably 50% by mass or less, more preferably 40% by mass or less, even more preferably 30% by mass or less, and most preferably 20% by mass or less. The hardness and abrasion resistance of the thermal spray coating that is formed out of the thermal spray powder increases with increasing content of the ceramic (i.e., with decreasing content of the metal).

The content of the ceramic in the granulated and sintered cermet particles is preferably 95% by mass or less, more preferably 92% by mass or less, and even more preferably 90% by mass or less. In other words, the content of the metal in the granulated and sintered cermet particles is preferably 5% by mass or more, more preferably 8% by mass or more, and even more preferably 10% by mass or more. As the content of the ceramic decreases (i.e., as the content of the metal increases), the plastic deformability of the granulated and sintered cermet particles increases, and as a result, the deposit efficiency of the thermal spray powder increases.

The upper limit of the average particle size (volume average particle size) of the granulated and sintered cermet particles is 30 μm. The granulated and sintered cermet particles are readily heated during thermal spraying, and, accordingly, the deposit efficiency of the thermal spray powder is improved, if the average particle size of the granulated and sintered cermet particles is 30 μm or less. Also, the denseness of the thermal spray coating that is formed out of the thermal spray powder increases in such a case. This translates into increased hardness and abrasion resistance of the thermal spray coating. In view of further improving the deposit efficiency of the thermal spray powder as well as the hardness and abrasion resistance of the thermal spray coating, the average particle size of the granulated and sintered cermet particles is preferably 25 μm or less, more preferably 20 μm or less, and even more preferably 15 μm or less. The measurement of the average particle size of the granulated and sintered cermet particles can be performed, for instance, in accordance with methods such as laser diffraction scattering, BET, light scattering or the like. The average particle size of the granulated and sintered cermet particles can be measured, in accordance with laser diffraction scattering, for instance by using a laser diffraction/scattering-type particle size measuring instrument "LA-300" manufactured by Horiba Ltd.

The average particle size of the granulated and sintered cermet particles is preferably 1 μm or more, more preferably 3 μm or more, and even more preferably 5 μm or more. The flowability of the thermal spray powder increases, and, as a result, the thermal spray powder is easily supplied to a thermal spray device, as the average particle size of the granulated and sintered cermet particles becomes larger.

The upper limit of the average particle size (average Feret's diameter) of the primary particles, i.e., the ceramic primary particles and the metal primary particles, in the granulated and sintered cermet particles is 6 μm. When the average particle size of the primary particles in the granulated and sintered cermet particles is 6 μm or less, the granulated and sintered cermet particles are readily heated during thermal spraying, and, accordingly, the deposit efficiency of the thermal spray powder is improved. Also, the denseness of the thermal spray coating that is formed out of the thermal spray powder increases in such a case, which translates into increased hardness and abrasion resistance of the thermal spray coating. In view of further improving the deposit efficiency of the thermal spray powder as well as the hardness and abrasion resistance of the thermal spray coating, the average particle size of the primary particles in the granulated and sintered cermet particles is preferably 5 μm or less, and more preferably 4.5 μm or less. The average particle size of the primary particles in the granulated and sintered cermet particles can be measured, for instance, using a scanning electron microscope "S-3000N" manufactured by Hitachi High-Technologies Corporation.

The average particle size of the primary particles in the granulated and sintered cermet particles is preferably 0.01 μm or more, more preferably 0.03 μm or more, and even more preferably 0.05 μm or more. The manufacturing costs of the thermal spray powder decrease as the average particle size of the primary particles in the granulated and sintered cermet particles becomes larger.

The compressive strength of the granulated and sintered cermet particles ranges from 100 to 600 MPa. Within that range, the granulated and sintered cermet particles are readily heated during thermal spraying, and, accordingly, the deposit efficiency of the thermal spray powder is improved.

The compressive strength of the granulated and sintered cermet particles can be measured, for instance, using a micro-compression tester "MCTE-500" manufactured by Shimadzu Corporation.

Preferably, the compressive strength of the granulated and sintered cermet particles is 200 MPa or more. The hardness and abrasion resistance of the thermal spray coating that is formed out of the thermal spray powder increase as the compressive strength of the granulated and sintered cermet particles becomes higher.

The compressive strength of the granulated and sintered cermet particles is preferably 500 MPa or less, and more preferably 400 MPa or less. The deposit efficiency of the thermal spray powder increases as the compressive strength of the granulated and sintered cermet particles decreases.

The present embodiment affords the below-described advantages.

The thermal spray powder of the present embodiment includes granulated and sintered cermet particles that contain a metal having an indentation hardness of 500 to 5,000 $N/mm^2$. The average size of the granulated and sintered cermet particles is 30 μm or less. The granulated and sintered cermet particles are composed of primary particles having an average size of 6 μm or less. The compressive strength of the granulated and sintered cermet particles ranges from 100 to 600 MPa. As a result, the thermal spray powder is capable of forming a coating with high deposit efficiency, and a thick thermal spray coating is formed efficiently by a low-temperature thermal spraying process.

The hardness and abrasion resistance of the thermal spray coating is increased if the indentation hardness of the metal in the granulated and sintered cermet particles is 700 $N/mm^2$ or more and even more so if the indentation hardness is 1,000 $N/mm^2$ or more.

The deposit efficiency of the thermal spray powder is improved if the indentation hardness of the metal in the granulated and sintered cermet particles is 4,000 $N/mm^2$ or less and even more so if the indentation hardness is 3,000 $N/mm^2$ or less.

The hardness and abrasion resistance of the thermal spray coating is increased if the content of the ceramic in the granulated and sintered cermet particles is 50% by mass or more and even more so if the content is 60% by mass or more, 70% by mass or more, or 80% by mass or more.

The deposit efficiency of the thermal spray powder is improved if the content of the ceramic in the granulated and sintered cermet particles is 95% by mass or less and even more so if the content is 92% by mass or less, or 90% by mass or less.

The flowability of the thermal spray powder is increased if the average size of the granulated and sintered cermet particles is 1 μm or more and even more so if the average particle size is 3 μm or more, or 5 μm or more.

The deposit efficiency of the thermal spray powder is improved if the average size of the granulated and sintered cermet particles is 25 μm or less and even more so if the average particle size is 20 μm or less, or 15 μm or less. The hardness and abrasion resistance of the thermal spray coating are likewise increased.

The manufacturing costs of the thermal spray powder are reduced if the average size of the primary particles in the granulated and sintered cermet particles is 0.01 μm or more and even more so if the average primary particle size is 0.03 μm or more, or 0.05 μm or more.

The deposit efficiency of the thermal spray powder is improved if the average size of the primary particles in the granulated and sintered cermet particles is 5 μm or less and even more so if the average primary particle size is 4.5 μm or less. The hardness and abrasion resistance of the thermal spray coating are likewise increased.

The hardness and abrasion resistance of the thermal spray coating is increased if the compressive strength of the granulated and sintered cermet particles is 200 MPa or more.

The deposit efficiency of the thermal spray powder is improved if the compressive strength of the granulated and sintered cermet particles is 500 MPa or less and even more so if the compressive strength is 400 MPa or less.

Instances where the thermal spray powder of the present embodiment is thermally sprayed by cold spraying are less likely to result in thermal alteration or thermal deformation of the substrate, than instances of thermal spraying by other low-temperature thermal spraying processes, for instance warm spraying and HVAF thermal spraying, since in cold spraying the process temperature, i.e., the temperature of the thermal spray powder during thermal spraying, is low. Safety is likewise superior since the working gas that is used is not a combustion gas.

Thermal spraying can be performed in a simpler manner and less expensively if a working gas that is used in cold spraying is nitrogen gas as compared with instances where helium gas is used as the working gas.

The above-described embodiment may be modified as follows.

The granulated and sintered cermet particles in the thermal spray powder may contain components other than the ceramic and metal, for instance, additives or unavoidable impurities.

The thermal spray powder may contain components other than the granulated and sintered cermet particles.

The present invention will be described in further detail by way of examples and comparative examples.

Thermal spray powder of Examples 1 to 8 and Comparative Examples 1 to 5 made of granulated and sintered cermet particles were prepared and were thermally sprayed under the conditions given Table 1.

The column entitled "composition of granulated and sintered cermet particles" in Table 2 denotes the chemical composition of the granulated and sintered cermet particles of the respective thermal spray powder. In that column, "WC-12% Ni" denotes a cermet having 12% by mass of nickel with the balance of tungsten carbide. Similarly, "WC-20% CrC-7% Ni" denotes a cermet having 7% by mass of nickel and 20% by mass of chromium carbide with the balance of tungsten carbide. The other denotations follow this pattern. The chemical composition of the granulated and sintered cermet particles was measured using an X-ray fluorescence analyzer "LAB CENTER XRF-1700" manufactured by Shimadzu Corporation and a carbon analyzer "WC-200" manufactured by LECO.

The column entitled "indentation hardness of metal" in Table 2 denotes the result of measurement of the indentation hardness of the metal contained in the granulated and sintered cermet particles of the respective thermal spray powder. The indentation hardness was measured using a nano-indentation hardness tester "ENT-1100a" manufactured by Elionix, with a triangular pyramid shaped diamond indenter, at a test load of 100 mN and a step interval of 20 milliseconds.

The column entitled "average size of primary particles" in Table 2 denotes the result of measurement of the average size (average Feret's diameter) of the primary particles in the granulated and sintered cermet particles of the respective thermal spray powder. The measurement was performed using a scanning electron microscope "S-3000N" manufactured by Hitachi High-Technologies Corporation. Specifically, reflection electron images were observed, at 5,000-fold magnification, of cross sections of six granulated and sintered cermet particles having a particle size within ±3 μm of the average particle size of the granulated and sintered cermet particles. The average size of the primary particles was determined on the basis of the obtained cross-sectional photographs of the particles.

The column entitled "average size of granulated and sintered cermet particles" in Table 2 denotes the result of measurement of the average size (volume average size) of the granulated and sintered cermet particles of the respective thermal spray powder. The measurement was performed using a laser diffraction/scattering-type particle size measuring instrument "LA-300" manufactured by Horiba Ltd.

The column entitled "compressive strength" in Table 2 denotes the results of measurement of the compressive strength of the granulated and sintered cermet particles of the respective thermal spray powder. Specifically, the compressive strength denotes the mean value of compressive strength σ (units: MPa) of ten granulated and sintered cermet particles as calculated according to the expression $\sigma=2.8\times L/\pi/d^2$. In the expression, L represents the critical load (units: N), and d represents the average size (units: mm) of the granulated and sintered cermet particles. The critical load denotes the magnitude of the compressive load that acts on a granulated and sintered cermet particle at a point in time at which there increases abruptly the displacement of an indenter that exerts, onto the granulated and sintered cermet particle, a compressive load that increases at a constant rate. A micro compression tester "MCTE-500" manufactured by Shimadzu Corporation was used to measure the critical load.

The column entitled "working gas type" in Table 2 denotes the type of working gas that was used during thermal spraying of the respective powders for thermal spraying under the conditions given in Table 1.

The column entitled "coating forming ability (1)" in Table 2 denotes the result of an evaluation of coating forming ability of the respective thermal spray powder on the basis of the thickness of the thermal spray coating that was formed per pass, during thermal spraying of the respective thermal spray powder, under the conditions given in Table 1. Specifically, the evaluation grades were: good (○) for instances where the thickness of thermal spray coating formed per pass was 40 μm or more, acceptable (Δ) for instances of thickness less than 40 μm, and poor (x) for instances where formation of a thermal spray coating was not observed.

The column entitled "coating forming ability (2)" in Table 2 denotes the result of an evaluation of coating forming ability of the respective thermal spray powder on the basis of whether or not a thermal spray coating could be formed that had a thickness appropriate for practical use, during thermal spraying of the respective thermal spray powder, under the conditions given in Table 1. Specifically, the evaluation grades were: good (○) for instances where, over a plurality of repeated passes, a 150 μm-thick thermal spray coating was formed; acceptable (Δ) for instances where a 150 μm-thick thermal spray coating was not formed, but a 100 μm-thick thermal spray coating was formed; and poor (x) for instances where a 100 μm-thick thermal spray coating failed to be formed, even over a plurality of repeated passes.

TABLE 1

| |
|---|
| Thermal spray machine: cold spray device "PCS-304" manufactured by Plasma Giken Co., Ltd. |
| Working gas type: nitrogen or helium |
| Working gas pressure: 4.0 MPa |
| Working gas temperature: 800° C. |
| Thermal spraying distance: 20 mm |
| Traverse velocity: 300 mm/sec |
| Feeder rotation speed: 1 rpm |
| Substrate: rolled steel for general structures SS400 |

TABLE 2

| | Composition of granulated and sintered cermet particles | Indentation hardness of metal ($N/mm^2$) | Average size of primary particles (μm) | Average size of granulated and sintered cermet particles (μm) | Compressive strength (MPa) | Working gas type | Coating forming ability (1) | Coating forming ability (2) |
|---|---|---|---|---|---|---|---|---|
| Example 1 | WC-12% Ni | 2200 | 0.5 | 14.1 | 250 | Nitrogen | ○ | ○ |
| Example 2 | WC-25% Ni | 2200 | 0.7 | 14.3 | 250 | Nitrogen | ○ | ○ |

TABLE 2-continued

| | Composition of granulated and sintered cermet particles | Indentation hardness of metal ($N/mm^2$) | Average size of primary particles (μm) | Average size of granulated and sintered cermet particles (μm) | Compressive strength (MPa) | Working gas type | Coating forming ability (1) | Coating forming ability (2) |
|---|---|---|---|---|---|---|---|---|
| Example 3 | WC-20% CrC-7% Ni | 2200 | 0.7 | 14.2 | 250 | Nitrogen | ○ | ○ |
| Example 4 | WC-12% Cu | 1400 | 0.5 | 13.9 | 250 | Nitrogen | ○ | ○ |
| Example 5 | WC-25% Cu | 1400 | 0.7 | 14.1 | 250 | Nitrogen | ○ | ○ |
| Example 6 | WC-12% Fe | 3000 | 0.6 | 14.1 | 250 | Nitrogen | ○ | ○ |
| Example 7 | WC-25% Co | 3500 | 0.7 | 14.3 | 250 | Nitrogen | ○ | ○ |
| Comparative Example 1 | WC-25% Cr | 15000 | 0.6 | 14.4 | 250 | Nitrogen | x | x |
| Comparative Example 2 | WC-12% Ni | 2200 | 7.0 | 14.1 | 250 | Nitrogen | x | x |
| Comparative Example 3 | WC-12% Ni | 2200 | 0.5 | 44.7 | 250 | Nitrogen | x | x |
| Comparative Example 4 | WC-20% CrC-7% Ni | 2200 | 0.7 | 14.2 | 1200 | Nitrogen | x | x |
| Comparative Example 5 | WC-25% Fe | 3000 | 0.6 | 14.2 | 650 | Nitrogen | Δ | x |
| Example 8 | WC-20% CrC-7% Ni | 2200 | 0.7 | 14.2 | 250 | Helium | Δ | Δ |

As Table 2 shows, the evaluation for both coating forming ability criteria yielded grades of acceptable or better for the thermal spray powders of Examples 1 to 8. By contrast, the evaluation of both coating forming ability criteria was poor for the thermal spray powder of Comparative Example 1, in which the metal in the granulated and sintered cermet particles had an indentation hardness of 15,000 $N/mm^2$, i.e., an instance where the metal in the granulated and sintered cermet particles was chromium. The evaluation of the two coating forming ability criteria yielded at least one poor result for the thermal spray powder of Comparative Example 2, in which the average size of the primary particles in the granulated and sintered cermet particles was 7.0 μm, the thermal spray powder of Comparative Example 3, in which the average size of the granulated and sintered cermet particles was 44.7 μm, and the thermal spray powders of Comparative Examples 4 and 5, in which the compressive strength of the granulated and sintered cermet particles was 600 MPa or more.

The invention claimed is:

1. A thermal spray powder that is usable in a low-temperature thermal spraying process, comprising granulated and sintered cermet particles that contain a metal having an indentation hardness of 500 to 5,000 $N/mm^2$, wherein the granulated and sintered cermet particles have an average size of 30 μm or less, the granulated and sintered cermet particles are composed of primary particles having an average size of 6 μm or less, the granulated and sintered cermet particles have a compressive strength of from 100 to 600 MPa, and the metal contained in the granulated and sintered cermet particles includes at least one selected from the group consisting of iron, aluminum, copper, and silver.

2. The thermal spray powder according to claim 1, wherein the low-temperature thermal spraying process is cold spray that utilizes a working gas containing nitrogen as a main component.

3. A method for forming a thermal spray coating, the method comprising forming a thermal spray coating through a low-temperature thermal spraying process of the thermal spray powder according to claim 1.

* * * * *